US006539749B2

(12) United States Patent
Gibbs, III

(10) Patent No.: US 6,539,749 B2
(45) Date of Patent: Apr. 1, 2003

(54) COMBINATION EARRINGS AND NAPE CHAIN AND METHOD THEREFOR

(76) Inventor: Lawrence Gibbs, III, 3001 Lake East Dr., #2039, Las Vegas, NV (US) 89117

( * ) Notice: Subject to any disclaimer, the term of this patent is extended or adjusted under 35 U.S.C. 154(b) by 0 days.

(21) Appl. No.: 09/789,448

(22) Filed: Feb. 20, 2001

(65) Prior Publication Data

US 2002/0112506 A1 Aug. 22, 2002

(51) Int. Cl.[7] ..... A44C 13/00

(52) U.S. Cl. ..... 63/1.11; 63/1.16; 63/12; 63/13; 63/3

(58) Field of Search ..... 63/1.11, 1.16, 63/1.18, 12, 13, 14.2, 3; 132/273, 275; D28/39

(56) References Cited

U.S. PATENT DOCUMENTS

| | | | | | |
|---|---|---|---|---|---|
| 1,556,106 | A | | 10/1925 | Hamilton | |
| D152,434 | S | * | 1/1949 | Pizzano et al. | D11/2 |
| 2,764,797 | A | * | 10/1956 | Carson | 24/543 |
| 3,082,431 | A | | 3/1963 | Watts | |
| 3,163,026 | A | | 12/1964 | Kenny | |
| 3,689,758 | A | * | 9/1972 | Power | 362/104 |
| 3,727,609 | A | * | 4/1973 | Hale | 606/204.35 |
| 3,898,868 | A | | 8/1975 | Tomlinson | |
| 4,783,974 | A | | 11/1988 | Hernandez | |
| 5,533,363 | A | * | 7/1996 | Callisto | 63/14.1 |
| D388,011 | S | * | 12/1997 | Leonard | D11/40 |
| 5,794,459 | A | * | 8/1998 | Ignatowski | 63/38 |
| D406,544 | S | * | 3/1999 | Leonard | D11/40 |
| D419,908 | S | * | 2/2000 | Leonard | D11/86 |
| 6,131,585 | A | * | 10/2000 | Reinstein et al. | 132/275 |

* cited by examiner

*Primary Examiner*—J. J. Swann
*Assistant Examiner*—Andrea Chop
(74) *Attorney, Agent, or Firm*—Harry M. Weiss; Jeffrey Weiss; Weiss, Moy & Harris, P.C.

(57) ABSTRACT

A combination earrings and nape chain and method therefor comprising a set of earrings and a chain coupled thereto. One embodiment of the combination earrings and nape chain comprises a chain dimensioned to restrict the movement of hair proximate the nape. Another embodiment of the combination earrings and nape chain comprises a chain dimensioned to adorn the nape. In all embodiments, the length of the chain varies in proportion to the size of the nape, the amount and type of hair, and the personal preference of the wearer.

7 Claims, 1 Drawing Sheet

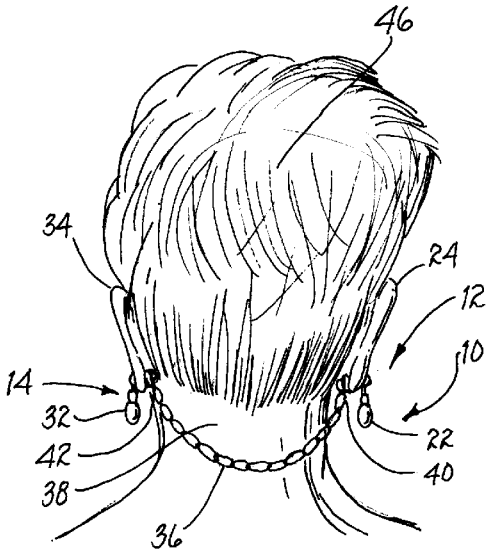
FIG. 2
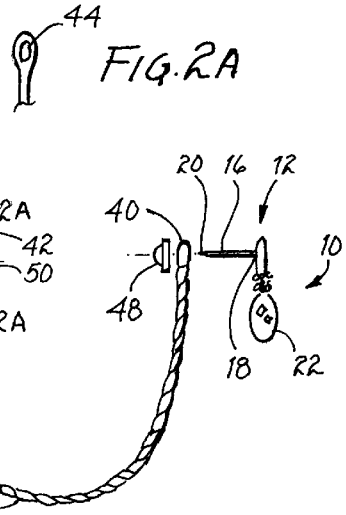
FIG. 2A
FIG. 1
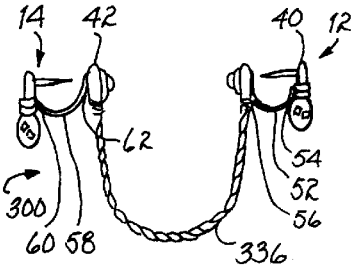
FIG. 7
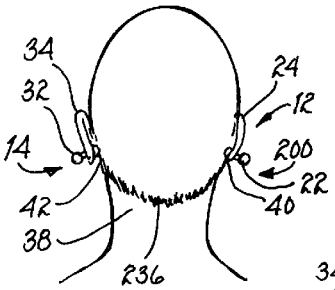
FIG. 3
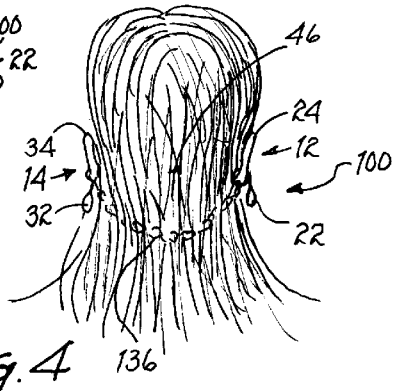
FIG. 4
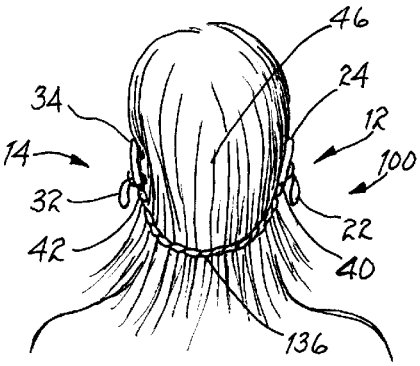
FIG. 5
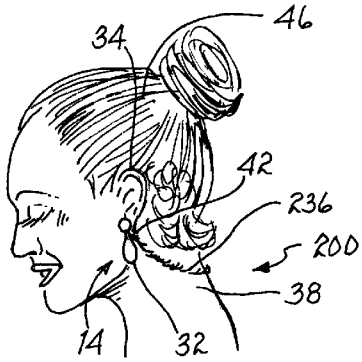
FIG. 6

COMBINATION EARRINGS AND NAPE CHAIN AND METHOD THEREFOR

FIELD OF THE INVENTION

This invention relates generally to earrings and decorative chains, and, more specifically, to a set of earrings coupled to a decorative chain dimensioned to hang across the nape of a person, and, in one embodiment, restrict the movement of hair proximate the nape.

BACKGROUND OF THE INVENTION

Earrings are a popular form of jewelry for both women as well as men. Earrings come in many different shapes and sizes, some of which are coupled to ornaments which dangle from the ear lobe, while others are coupled to ornaments which are proximate the skin of the ear. Each variation of the earring creates a different kind of style. Some earrings have been coupled to a necklace or chain. It is often the case, however, that a person's nape is left unadorned by an earring-coupled form of jewelry. In addition, a chain adorning the nape of a person is also capable of restricting the movement of hair proximate the nape in order to prevent the hair from getting in a person's way.

Various attempts have been made to create earrings coupled to a chain of some sort. For example, U.S. Pat. No. 4,783,974 issued to Hernandez discloses a chain which rests on the front portion of the neck of a person. The Hernandez patent does not demonstrate the use of a chain as a mechanism for adorning the nape of a person or for restricting the movement of hair proximate the nape. U.S. Pat. No. 1,556,103 issued to Hamilton discloses earrings which are coupled to both a necklace having a pendant chain on the front portion of the neck and a pendant chain attached to the earrings and designed to fall on the back of a person. The back pendant chain of the Hamilton patent rests on the back and is not dimensioned to adorn the nape, nor is it designed to restrict the movement of hair proximate the nape. U.S. Pat. No. 3,898,868 issued to Tomlinson discloses a tiara coupled to earrings, U.S. Pat. No. 3,082,431 issued to Watts shows a front head covering coupled to earrings, and U.S. Pat. No. 3,163,026 issued to Kenny discloses a hairpin coupled to an earring through a chain, but the Tomlinson, Watts, and Kenny patents do not disclose any adornment of the nape or securement of the hair proximate the nape.

A need therefore existed for a set of earrings coupled to a chain capable of adorning the nape and/or securing hair proximate the nape.

SUMMARY OF THE INVENTION

An object of the present invention is to provide a combination earrings and nape chain and method therefor for hanging a chain across a nape to adorn the nape.

It is a further object of the present invention to provide a combination earrings and nape chain and method for hanging a chain across a nape to secure hair proximate the nape.

It is yet a further object of the recount invention to provide a combination earrings and nape chain and method for hanging a chain across a nape comprising a unitary assembly.

BRIEF DESCRIPTION OF THE PREFERRED EMBODIMENTS

In accordance with one embodiment of the present invention, a combination earrings and nape chain is disclosed, comprising, in combination, a first earring comprising: a first ear pin having a first end and a second end, and a first ornament coupled to the first end of the first ear pin, the first ear pin extends through an ear hole of a first ear, a second earring comprising: a second ear pin having a first end and a second end, and a second ornament coupled to the first end of the second ear pin, the second ear pin extends through an ear hole of a second ear, and a chain dimensioned to hang across a nape and having a first end and a second end, the first end is coupled to the first ear pin of the first earring, the second end is coupled to the second ear pin of the second earring.

In accordance with another embodiment of the present invention, a combination earrings and nape chain comprising, in combination, a first earring comprising: a first ear pin having a first end and a second end, and a first ornament coupled to the first end of the first ear pin, the first ear pin extends through an ear hole of a first ear, a second earring comprising: a second ear pin having a first end and a second end, and a second ornament coupled to the first end of the second ear pin, the second ear pin extends through an ear hole of a second ear, and a chain dimensioned to hang across a nape and having a first end and a second end, the first end is dimensioned to detachably receive the second end of the first ear pin of the first earring, the second end of the chain is dimensioned to detachably receive the second end of the second ear pin of the second earring.

In accordance with yet another embodiment of the present invention, a method for hanging a chain across a nape is disclosed, comprising, in combination, the steps of providing a first earring comprising: a first ear pin having a first end and a second end, and a first ornament coupled to the first end of the first ear pin, the first ear pin extends through an ear hole of a first ear, providing a second earring comprising: a second ear pin having a first end and a second end, and a second ornament coupled to the first end of the second ear pin, the second ear pin extends through an ear hole of a second ear, providing a chain dimensioned to hang across a nape and having a first end and a second end, coupling the first earring to the first ear, coupling the second earring to the second ear, coupling the first end of the chain to the second end of the first ear pin of the first earring, and coupling the second end of the chain to the second end of the second ear pin of the second earring.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

FIG. 1 is a front view of one embodiment of the combination earrings and nape chain of the present invention.

FIG. 2 is a back view of one embodiment of the combination earrings and nape chain of the present invention, showing the chain loosely adorning the nape.

FIG. 2A is a side view of the second end of the chain, taken along the line 2A—2A of FIG. 1.

FIG. 3 is a back view of one embodiment of the combination earrings and nape chain of the present invention, showing the chain tightly adorning the nape.

FIG. 4 is a back view of one embodiment of the combination earrings and nape chain of the present invention, showing the chain in phantom loosely adorning the nape under the hair.

FIG. 5 is a back view of one embodiment of the combination earrings and nape chain of the present invention, showing the chain restricting the movement of hair proximate the nape.

FIG. 6 is a side view of one embodiment of the combination earrings and nape chain of the present invention, showing the chain adorning the nape.

FIG. 7 is a front view of another embodiment of the combination earrings and nape chain, showing the earrings and chain comprising a unitary assembly.

DETAILED DESCRIPTION OF THE PREFERRED EMBODIMENTS

Referring to FIGS. 1 and 2, reference number 10 refers generally to one embodiment of the combination earrings and nape chain of the present invention. The combination earrings and nape chain 10 comprises a first earring 12 and a second earring 14. The first earring 12 comprises a first ear in 16 (shown in FIG. 1) having a first end 18 (shown in FIG. 1) and a second end 20 (shown in FIG. 1). A first ornament 22 is coupled to the first end 18 of the first ear pin 16 with the first ear pin 16 extending through an ear hole of a first ear 24 (shown in FIG. 2). The second earring 14 comprises a second ear pin 26 (shown in FIG. 1) having a first end 28 (shown in FIG. 1) and a second end 30 (shown in FIG. 1). A second ornament 32 is coupled to the first end 28 of the second ear pin 26 with the second ear pin 26 extending through an ear hole of a second ear 34 (shown in FIG. 2).

The combination earrings and nape chain 10 also comprises a chain 36 dimensioned to hang across a nape 38 (shown in FIG. 2). The chain 36 has a first end 40 and a second end 42. The first end 40 is coupled to the first ear pin 16 of the first earring 12 and the second end 42 is coupled to the second ear pin 26 of the second earring 14. In one embodiment, the first end 40 any the second end 42 each define an aperture 44 (shown in FIG. 2A) to allow the chain 36 to be slidably coupled to first ear pin 16 and the second ear pin 26, respectively, although it should be understood that substantial benefit could be derived from an alternative coupling mechanism so long as it allows for the chain 36 to be securely coupled to the first earring 12 and the second earring 14.

Referring now to FIG. 1, the combination earrings and nape chain 10 preferably further comprises a first clutching device 48 dimensioned to clutch the second end 20 of the first ear pin 16. The combination earrings and nape chain 10 preferably also comprises a second clutching device 50 dimensioned to clutch the second end 30 of the second ear pin 26. The first clutching device 48 is used to secure the first earring 12 to the first ear 24. Likewise, the second clutching device 50 is used to secure the second earring 14 to the second ear 34. While, it is preferable in this embodiment for a first clutching device 48 and a second clutching device 50 to be used to secure the first earring 12 to the first ear 24 and the second earring 14 to the second ear 34, respectively, it should be clearly understood that substantial benefit could be derived from an alternative configuration of the combination earrings and nape chain 10 in which an alternative securing mechanism is used, or no mechanism at all is used (such as with a curved ear pin) so long as the combination earrings and nape chain 10 can be securely coupled to the first ear 24 and the second ear 34.

The length of the chain 36 can vary depending on the function of the chain 36, the length of the nape 36, and the amount and type of hair 46. If, for example, the purpose of the combination earrings and nape chain 10 is to restrict the movement of hair 46, then the chain 36 will need to be of sufficient length to restrict hair 46 of various sizes from moving freely. Referring now to FIGS. 4–5, an embodiment of the combination earrings and nape chain 10, hereinafter 100, for restricting the movement of hair 46 is disclosed. The same reference numbers used in describing the features of the combination earrings and nape chain 10 of the present invention will be used when describing the identical features of the combination earrings and nape chain 100. The combination earrings and nape chain 100 is essentially the same as before, although the combination earrings and nape chain 100 comprises a chain 136 dimensioned to restrict the movement of hair 46 proximate the nape 38. Preferably, the chain 136 in this embodiment is at least approximately 13.5 inches in length from the first end 40 to the second end 42, although it should be understood that the chain length can deviate, even substantially, from the preferred length in either direction so long as the chain 136 is capable of restricting the movement of the hair 46 proximate the nape 38. The amount and thickness of the hair 46 which needs to be restricted will determine the necessary length of the chain 136. Thus, bushier hair will require a longer chain 136 (perhaps as long as 16 inches or more) while thinner hair will require a shorter chain 136 (as few as 10 inches or less). If a person does not want the chain 136 to restrict the movement of the hair 46, he or she can place the chain 136 portion of the combination earrings and nape chain 100 under the hair 46 (as shown in FIG. 4).

When the purpose of the chain 36 of the combination earrings and nape chain 10 is to adorn the nape 38, then the length of the chain 36 can vary depending on the size of the nape 38 and/or the personal taste of the wearer. Referring now to FIGS. 3 and 6, an embodiment of the combination earrings and nape chain 10, hereinafter 200, for the purpose of adorning the nape 38 is disclosed. The same reference numbers used in describing the features of the combination earrings and nape chain 10 of the present invention will be used when describing the identical features of the combination earrings and nape chain 200. The combination earrings and nape chain 200 is essentially the same as before, although the combination earrings and nape chain 200 comprises a chain 236 dimensioned to adorn the nape 38. Preferably, the chain 236 in this embodiment is at least approximately 10 inches in length from the first end 40 to the second end 42, although it should be understood that the chain length can deviate, even substantially, from the preferred length in either direction depending on the size of the nape 38 and/or the personal preference of the wearer. Thus, one wearer might choose a small chain 236 which tightly adorns the nape 38 (as shown in FIG. 3) and another wearer might choose a longer chain which loosely adorns the nape (as shown in FIG. 6).

Referring now to FIG. 7, an alternative embodiment of the combination earrings and nape chain 10, hereinafter 300, is disclosed. The same reference numbers used in describing the features of the combination earrings and nape chain 10 of the present invention will be used when describing the identical features of the combination earrings and nape chain 300. The combination earrings and nape chain 300 is essentially the same as before, although the first end 40 of the chain 336 is dimensioned to detachably receive the second end 20 of the first ear pin 16 of the first earring 12 and the second end 42 of the chain 336 is dimensioned to detachably receive the second end 30 of the second ear pin 26 of the second earring 14. With the first end 40 of the chain 336 and the second end 42 of the chain 336 securely receiving the first ear pin 16 and the second ear pin 26, respectively, the combination earrings and nape chain 300 has no need for a first clutching device 48 or a second clutching device 50. Preferably, the combination earrings and nape chain 300 further comprises a first securing chair 52 having a first end 54 and a second end 56. The first end 54 of the first securing chain 52 is coupled to the first earring 12 and the second end 56 of the first securing chain 52 is coupled to the first end 40 of the chain 336. Preferably, the combination earrings and nape chain 300 also comprises a second securing chain 58 having a first end 60 and a second end 62. The first end 60 of the second securing chain 58 is coupled to the second earring 14 and the second end 62 of the second securing chain 58 is coupled to the second end 42 of the chain 336. Together, the first securing chain 52 and the second securing chain 58 make the combination earrings and nape chain 300 unitary in assembly. This unitary design helps to prevent the loss of the first earring 12, the second earring 14 or the chain 336 since all of the pieces of the combination earrings and nape chain 300 are coupled together. Although, the combination earrings and nape chain 300 preferably comprises a first securing chain 52 and second securing chain 58, it should be clearly understood that substantial benefit could be derived from an alternative configuration of the combination earring and nape chain 300 which lacks securing chains.

While the invention has been particularly shown and described with reference to preferred embodiments thereof, it will be understood by those skilled in the art that the foregoing and other changes in form and details may be made therein without departing from the spirit and scope of the invention.

I claim:

1. A method for hanging a chain across a nape, comprising, in combination, the steps of:

providing a first earring comprising:

a first ear pin having a first end and a second end; and a first ornament coupled to said first end of said first ear pin, said first ear pin is adapted to extend through an ear hole of a first ear;

providing a second earring comprising:

a second ear pin having a first end and a second end; and a second ornament coupled to said first end of said second ear pin, said second ear pin is adapted to extend through an ear hole of a second ear;

providing a nape chain dimensioned for only hanging across a person's nape and having a first end and a second end, coupling said first end of said nape chain to said second end of said first ear pin of said first earring; and coupling said second end of said nape chain to said second end of said second ear pin of said second earring.

2. The method of claim 1 wherein said nape chain is dimensioned to restrict a movement of hair proximate said person's nape.

3. The method of claim 1 wherein said nape chain is dimensioned to contact and adorn said person's nape.

4. The method of claim 1 wherein said nape chain is at least approximately 10 inches in length from said first end of said of said nape chain to said second end of said nape chain.

5. The method of claim 1 wherein said nape chain is at least approximately 13.5 inches in length from said first end of said nape chain to said second end of said nape chain.

6. The method of claim 1 wherein said nape chain is at least approximately 16 inches in length from said first end of said nape chain to said second end of said nape chain.

7. A combination earrings and nape chain comprising, in combination:

a first earring comprising:

a first ear pin having a first end and a second end; and a first ornament coupled to said first end of said first ear pin, said first ear pin is adapted to extend through an ear hole of a first ear;

a second earring comprising:

a second ear pin having a first end and a second end; and a second ornament coupled to said first end of said second ear pin, said second ear pin is adapted to extend through an ear hole of a second ear;

a chain dimensioned to hang across a nape and having a first end and a second end, said first end of said chain is dimensioned to detachably receive said second end of said first ear pin of said first earring, said second end of said chain is dimensioned to detachably receive said second end of said second ear pin of said second earring;

a first securing chain having a first end and a second end, said first end of said first securing chain is coupled to said first earring, said second end of said first securing chain is coupled to said first end of said chain; and a second securing chain having a first end and a second end, said first end of said second securing chain is coupled to said second earring, said second end of said second securing chain is coupled to said second end of said chain.

* * * * *